US007245197B2

(12) United States Patent
Helosvuori et al.

(10) Patent No.: US 7,245,197 B2
(45) Date of Patent: Jul. 17, 2007

(54) LIQUID-COOLED CHOKE

(75) Inventors: Juhani Helosvuori, Vantaa (FI); Markku Talja, Järvenpää (FI)

(73) Assignee: ABB OY, Helsinki (FI)

( * ) Notice: Subject to any disclaimer, the term of this patent is extended or adjusted under 35 U.S.C. 154(b) by 209 days.

(21) Appl. No.: 11/045,520

(22) Filed: Jan. 31, 2005

(65) Prior Publication Data

US 2005/0179513 A1 Aug. 18, 2005

(30) Foreign Application Priority Data

Feb. 13, 2004 (FI) ..... 20040230

(51) Int. Cl.
*H01F 27/08* (2006.01)
*H01F 27/10* (2006.01)

(52) U.S. Cl. ..... 336/55; 336/60; 336/57

(58) Field of Classification Search ..... 336/55–58, 336/60; 361/676–677
See application file for complete search history.

(56) References Cited

U.S. PATENT DOCUMENTS 2,547,045 A 4/1951 Sabol
4,337,569 A * 7/1982 Pierce ..... 29/605
4,739,296 A 4/1988 Fukatsu
5,682,292 A 10/1997 Salanki
6,157,282 A * 12/2000 Hopkinson ..... 336/60
2004/0070475 A1 4/2004 Nick et al.

FOREIGN PATENT DOCUMENTS

| | | |
|---|---|---|
| DE | 3522740 | 10/1986 |
| DE | 3843807 | 7/1990 |
| EP | 0459326 | 12/1991 |
| GB | 732841 | 6/1955 |
| GB | 1 595 094 | 4/1979 |
| JP | 02-042707 | 2/1990 |

* cited by examiner

*Primary Examiner*—Anh Mai
(74) *Attorney, Agent, or Firm*—Dykema Gossett PLLC

(57) ABSTRACT

The invention relates to a liquid-cooled choke comprising a choke core (1), a choke coil (2) and a path (3) for a cooling liquid to cool the choke. The choke core (1) is divided into at least two parts (1*a*, 1*b*) arranged in a cooling profile (4) to which the path (3) for the cooling liquid is arranged and which at the same time provides the choke with a frame and an assembly jig.

13 Claims, 2 Drawing Sheets

LIQUID-COOLED CHOKE

BACKGROUND OF THE INVENTION

The invention relates to a liquid-cooled choke comprising a choke core, a choke coil and a path for a cooling liquid to cool the choke.

Heat losses occur both in the choke core and the choke coil. This heat should be transferred efficiently to the cooling liquid so that the choke would not be heated too much but would remain in the optimal operating temperature range defined for it.

U.S. Pat. No. 1,790,906 discloses a known solution where a two-piece coil is encapsulated such that a cooling liquid is circulated between the adjacent coils and on their edges in water channels arranged in the middle and ends of the encapsulation. Considering the basic structure of the choke, the implementation is relatively complex, and only the coil will be cooled in this way.

Another, newer arrangement is disclosed, for instance, in EP Patent 459326 where cooling liquid channels are arranged between different layers of the coil in the cast-resin body of the coil. Also this structure is very difficult to implement and it does not take the cooling demand of the core into account.

Typical of the former structures is that the cooling is in one way or another implemented in connection with the coil. These implementations also make the assembly and structure of the choke difficult and complex.

SUMMARY OF THE INVENTION

It is an object of the present invention to provide a choke, by which the above-mentioned drawbacks can be eliminated and heat losses of the core and coil can be efficiently transferred to a cooling liquid.

This object is achieved by a choke of the invention, which is primarily characterized in that the choke core is divided into at least two parts arranged in a cooling profile to which the path for the cooling liquid is arranged and which at the same time provides the choke with a frame and an assembly jig.

In a first preferred implementation of the invention the choke core is formed of two plate packs and the cooling profile comprises recesses for the plate packs on two opposing sides of the profile, whereby the cooling profile extends in between the disc packs and from there to two sides of each plate pack, and around the sides of the cooling profile covering the plate packs and the two bare sides of the plate packs there is an insulation and on top of the insulation there is the choke coil.

In a second preferred implementation of the invention the choke core is formed of three plate packs, and the cooling profile comprises on its edges or circumference recesses for the plate packs at regular intervals, the plate packs being symmetrically arranged with respect to the central axis of the cooling profile, whereby the cooling profile extends into the middle of the plate packs and from there to two sides of each plate pack, and around the profile parts between the plate packs and the bare sides of each plate pack there is an insulation and on top of the insulation there is the choke coil. This solution enables a more efficient cooling both for the core and the coil. Furthermore, the plate packs can be shortened and, if desired, three chokes can be arranged in the same cooling profile column by only insulating the core plate packs from each other, which saves material and space.

In a third preferred implementation of the invention the choke core is formed of three columns and the cooling profile comprises three openings on the same circular arch at regular intervals, into which the columns are positioned, the surfaces of the columns being lined with an insulation and a coil arranged on top of the insulation. Here, three separate chokes are in a way connected to the same cooling body of the invention to form one choke unit. If chokes are used, for instance, in the branches of an IGBT module, three three-column chokes are needed for one converter. Correspondingly, nine "one-column" chokes according to the first implementation are needed.

In each implementation, the path of the cooling liquid to the cooling profile is arranged symmetrically in the middle of the choke core parts, the material of the cooling profile being preferably aluminum or a mixture thereof. If required, at desired points the cooling profile can be provided with additional cooling channels according to cooling power demand.

LIST OF FIGURES

The invention will now be described by means of three preferred embodiments with reference to the attached drawings, in which FIG. 1 is a cross section of a first embodiment of the invention;

DETAILED DESCRIPTION OF THE INVENTION

The output of an inverter typically comprises an output choke as a part of the filter to limit du/dt, i.e. change of voltage (u) with respect to time (t), and common mode currents, which further cause bearing currents and insulation load on the motor. The choke is a yoke-free type of choke.

Figure 1:
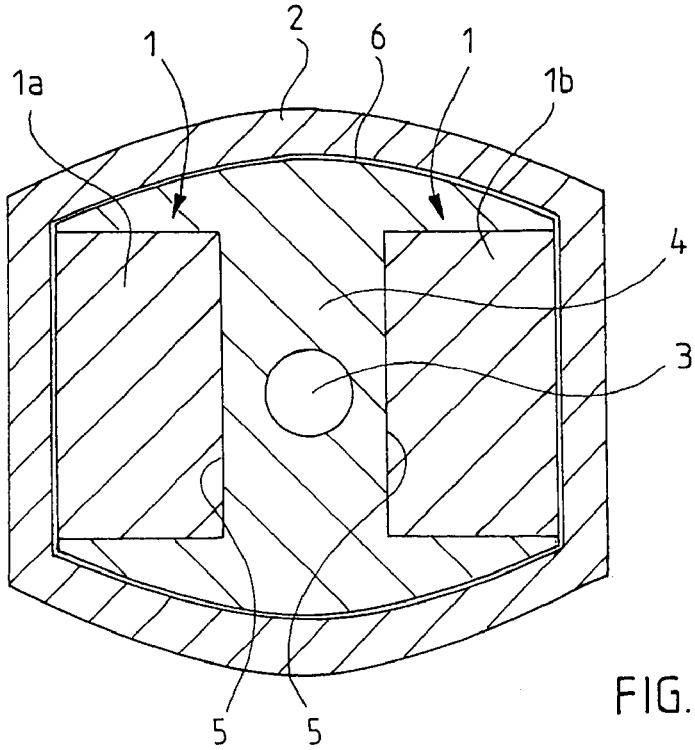

FIG. 1 shows a "one-column" liquid-cooled choke of the invention, comprising a choke core 1, a choke coil 2 and a path 3 for a cooling liquid to cool the choke.

The choke core is divided into two parts 1*a* and 1*b* arranged in a cooling profile 4 to which the path 3 for the cooling liquid is arranged and which at the same time provides the choke with a frame and an assembly jig, as will be described in the following.

The divided choke core 1 is formed of two identical iron plate packs 1*a* and 1*b*, for which the cooling profile 4 comprises accurately dimensioned recesses 5 on its two opposing sides. When assembling the choke, the plates of the plate packs 1*a* and 1*b* are piled into the recesses 5 so that the cooling profile 4 extends in between the plate packs 1*a* and 1*b* and from there to two sides of each plate pack 1*a* and 1*b*, having a tight contact with the plate packs 1*a* and 1*b*. Then, an insulation 6 is wrapped around the sides of the cooling profile 4 covering these plate or core packs 1*a* and 1*b* and around the two bare sides, i.e. sides not covered with the cooling profile 4, of the core packs 1*a* and 1*b*, and the choke coil 2 made of profiled copper is coiled on top of the insulation. Finally, the packet thus formed is insulated and lacquered.

The path for the cooling liquid is here a channel 3 bored into the cooling profile 4 or formed in the extrusion phase, passing through the cooling profile 4 in the middle of the core packs 1*a* and 1*b*. Only two connections, input and output, are needed to circulate the cooling liquid. In this way, the core packs 1*a* and 1*b* are cooled effectively, and since the majority of the coil 2 is on top of the cooling profile 4, the effective cooling of the coil 2 is also secured. The material of the cooling profile 4 is preferably aluminum or a suitable mixture thereof.

Figure 2:
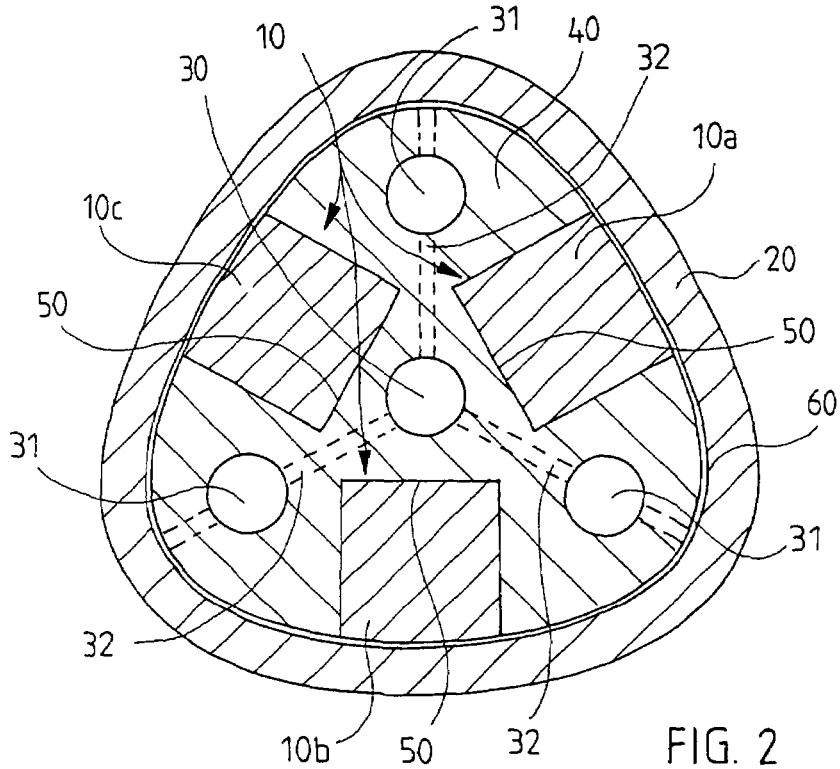
FIG. 2 is a cross section of a second embodiment of the invention.

The choke shown in FIG. 2 differs from the structure of FIG. 1 primarily in that the choke core 10 is formed of three plate packs 10*a*, 10*b* and 10*c*. The cooling profile 40 comprises on its edges or circumference at regular intervals recesses 50 for the plate packs 10*a*, 10*b* and 10*c*, which are formed as in FIG. 1. The plate packs 10*a*, 10*b* and 10*c* are arranged symmetrically with respect to the central axis of the cooling profile 40, and the cooling profile 40 extends into the middle of the plate pacts 10*a*, 10*b* and 10*c* and from there to two sides of each plate pack. Like in FIG. 1, an insulation 60 is arranged around the profile parts between the plate packs 10*a*, 10*b* and 10*c* and around the bare side of each plate pack 10*a*, 10*b* and 10*c* and a choke coil 20 is arranged on top of the insulation. Also here, a path 30 for a cooling liquid is a channel 30 bored into the cooling profile 40 or formed in the extrusion phase, passing through the cooling profile 40 in the middle of the plate packs 10*a*, 10*b* and 10*c*. In addition, the figure shows feasible additional cooling channels 31, which may be located between each two core packs, for instance. These channels 31 can be connected to the main channel 30 by means of connecting channels 32. The cross section of the cooling profile 40 is preferably an intermediate form between a triangle and a circle, where no sharp angles are present and the coiling is easy to implement.

Figure 3:
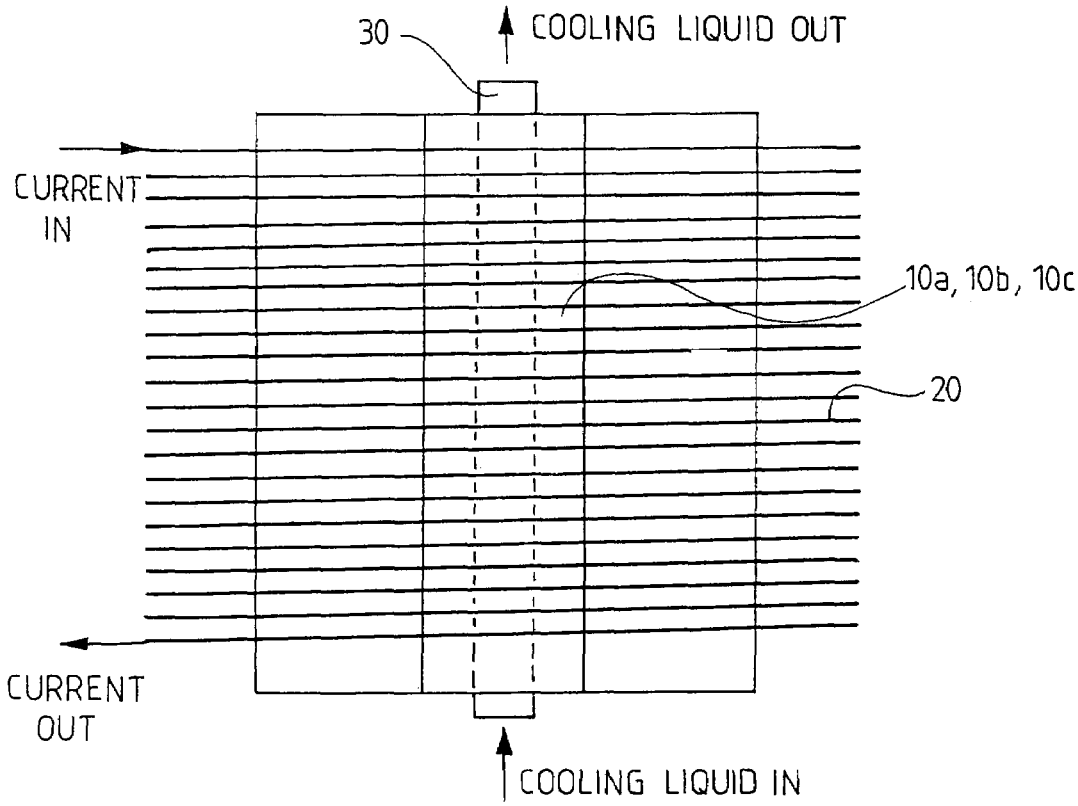
FIG. 3 shows a choke column employing chokes of FIG. 2.

The solution of FIG. 2 enables a more efficient cooling for both the core plate packs 10*a*, 10*b* and 10*c* and the coil 20, as was already stated in the beginning. In addition, the plate packs 10*a*, 10*b* and 10*c* can be shortened and, if desired, three different chokes can be arranged according to FIG. 3 in the same cooling profile column 41 by only insulating the plate packs 10*a*, 10*b* and 10*c* of the chokes from each other by means of insulations 70. Measurements have shown that crosstalk takes place so that the current of the middlemost, also hottest, branch of the IGBT module decreases suitably. Crosstalk can be controlled by changing the distance of the coils 20.

Compared to the prior art, the choke provided with the cooling profiles 4 and 40 not only eliminates problems associated with cooling but also prevents the twisting of the iron core pack in conventional chokes, while the coil is coiled around it. It is, namely, difficult to coil thick profiled copper around the plate pack provided only with corner supports in such a manner that the pack will not be twisted.

Compromises with respect to the cross-sectional surface of the coil 2 and 20 (i.e. the copper layer) can be made with an efficient cooling. The reduction of the cross-sectional surface increases resistance, which is, up to a certain extent, useful in the yoke-free output choke of the inverter.

Figure 4:
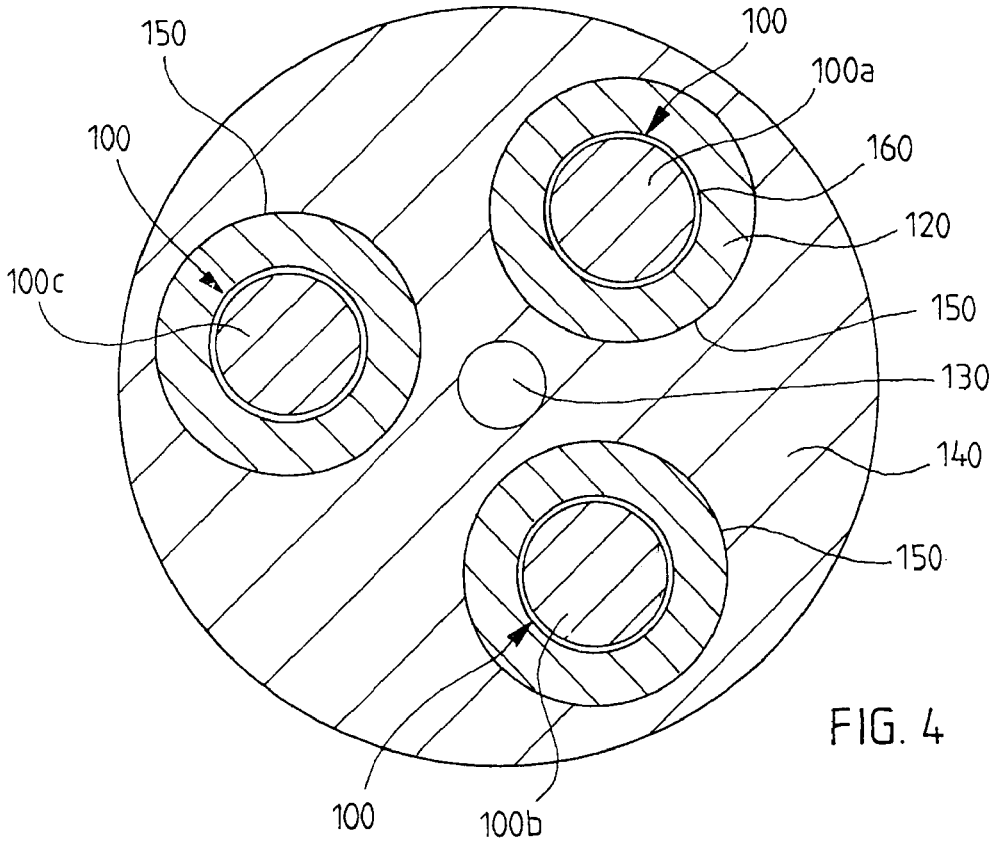
FIG. 4 is a cross section of a third embodiment of the invention.

FIG. 4 shows a third implementation of the choke of the invention. A choke core 100 is formed of three columns 100*a*, 100*b* and 100*c*, and a cooling profile 140 comprises three openings 150 on the same circular arch at regular intervals, into which the columns are positioned, the surfaces of the columns being lined with an insulation 160 and a coil 120 arranged on top of the insulation. Here, three separate chokes are in a way connected to the same cooling body of the invention to form one choke unit, as was already stated in the beginning.

Also here, the path for the cooling liquid is arranged in the cooling profile as a channel 130 extending in the middle of the choke core parts, as was the case also in FIGS. 1 and 2, and the cooling profile is preferably made of aluminum or an aluminum mixture.

The above specification is only intended to illustrate the basic idea of the invention. However, a person skilled in the art can modify the details of the invention within the scope of the attached claims.

The invention claimed is:

1. A liquid-cooled choke comprising a choke core, a choke coil and a path for a cooling liquid to cool the choke, wherein the choke core is divided into at least two parts arranged in a cooling profile to which the path for the cooling liquid is arranged and which at the same time provides the choke with a frame and an assembly jig wherein the choke core is formed of two plate packs and the cooling profile comprises recesses for the plate packs on two opposing sides of the profile, whereby the cooling profile extends in between the plate packs and from there to two sides of each plate pack, insulation disposed around the sides of the cooling profile covering the plate packs and two bare sides of the plate packs and the choke coil is positioned on two of the insulation.

2. A choke as claimed in claim 1, wherein the path for the cooling liquid is arranged in the cooling profile in the middle of the parts of the choke core.

3. A choke as claimed in claim 1, wherein the cooling profile is provided with additional cooling channels at desired points.

4. A choke as claimed in claim 1, wherein the cooling profile is made of aluminum or an aluminum mixture.

5. A liquid-cooled choke comprising a choke core, a choke coil and a path for a cooling liquid to cool the choke, wherein the choke core is divided into at least two parts arranged in a cooling profile to which the path for the cooling liquid is arranged and which at the same time provides the choke with a frame and an assembly jig, wherein the choke core is formed of three plate packs and the cooling profile comprises on its edges or circumference recesses for the plate packs at regular intervals, the plate packs being symmetrically arranged with respect to the central axis of the cooling profile, whereby the cooling profile extends into the middle of the plate packs and from there to two sides of each plate pack, an insulation is disposed around the profile parts between the plate packs and bare sides of each plate pack and the choke coil is located on top of the insulation.

6. A choke as claimed in claim 5, wherein three separate chokes are arranged in the same cooling profile column, whereby the plate packs of the chokes on top of each other are insulated from each other by means of protection insulations.

7. A choke as claimed in claim 5, wherein the path for the cooling liquid is arranged in the cooling profile in the middle of the parts of the choke core.

8. A choke as claimed in claim 5, wherein the cooling profile is provided with additional cooling channels at desired points.

9. A choke as claimed in claim 5, wherein the cooling profile is made of aluminum or an aluminum mixture.

10. A liquid-cooled choke comprising a choke core, a choke coil and a path for a cooling liquid to cool the choke, wherein the choke core is divided into at least two parts arranged in a cooling profile to which the path for the cooling liquid is arranged and which at the same time provides the choke with a frame and an assembly jig, wherein the choke core is formed of three columns and the cooling profile comprises a circular arch having three openings at regular intervals, into which the columns are positioned, the surfaces of the columns being lined with an insulation and a coil arranged on top of the insulation.

11. A choke as claimed in claim 10, wherein the path for the cooling liquid is arranged in the cooling profile in the middle of the parts of the choke core.

12. A choke as claimed in claim 10, wherein the cooling profile is provided with additional cooling channels at desired points.

13. A choke as claimed in claim 10, wherein the cooling profile is made of aluminum or an aluminum mixture.

* * * * *